United States Patent [19]

Fraenkel et al.

[11] 4,203,522

[45] May 20, 1980

[54] METHOD AND APPARATUS FOR SORTING AGRICULTURAL PRODUCTS

[75] Inventors: Herbert Fraenkel, London; Patrick B. Gough, Wallington; William S. Maughan, Burgess Hill, all of England

[73] Assignee: Sortex North America, Inc., Lowell, Mich.

[21] Appl. No.: 938,390

[22] Filed: Aug. 31, 1978

[30] Foreign Application Priority Data

Jun. 28, 1978 [GB] United Kingdom ..... 28133/78

[51] Int. Cl.[2] ..... B07C 5/342

[52] U.S. Cl. ..... 209/558; 209/577; 209/581; 250/226; 356/407

[58] Field of Search ..... 209/555, 558, 576, 577, 209/580, 581, 582; 250/226; 356/407

[56] References Cited

U.S. PATENT DOCUMENTS

| | | | |
|---|---|---|---|
| 2,967,614 | 1/1961 | Nury et al. | 209/580 X |
| 4,035,636 | 7/1977 | Tengater | 209/580 X |
| 4,095,696 | 6/1978 | Sherwood | 209/581 |
| 4,120,402 | 10/1978 | Swanson | 209/580 X |

FOREIGN PATENT DOCUMENTS

| | | | |
|---|---|---|---|
| 993063 | 5/1965 | United Kingdom | 209/582 |

*Primary Examiner*—Joseph J. Rolla

*Attorney, Agent, or Firm*—Cushman, Darby & Cushman

[57] ABSTRACT

A sorting machine for sorting ground nuts affected by a mould which produces aflatoxin comprises detectors for detecting infra-red (or red) and green light respectively reflected from a ground nut being viewed. The infra-red detector produces a first signal indicative of the amount of mould carried by the ground nut. The green detector produces a signal indicative of the extent to which the ground nut is mechanically damaged, and also produces a gating signal. A comparison signal is derived from these first and second signals and is passed by way of a gate and a level detector to an ejector. The gating signal controls the operation of the gate in dependence upon the extent to which the ground nut being viewed is mechanically damaged, so that the ejector is actuated by comparison signals of a predetermined level only when the extent to which the ground nut is mechanically damaged does not exceed a predetermined value.

12 Claims, 2 Drawing Figures

METHOD AND APPARATUS FOR SORTING AGRICULTURAL PRODUCTS

BACKGROUND OF THE INVENTION

This invention concerns a method and an apparatus for effecting relative separation between desired and undesired agricultural products, e.g. between mould-carrying agricultural products and agricultural products free of such mould.

Although the invention is applicable to the sorting of a number of different agricultural products, e.g. maize, it is more particularly applicable to the sorting of oil stock ground nuts which are liable to be contaminated by a toxic mould which produces aflatoxin.

After the oil has been extracted from ground nuts, the material remaining may be formed into a cattle cake. However, if the said ground nuts have been contaminated by aflatoxin, the cattle cake made therefrom is similarly contaminated, and since aflatoxin is highly toxic, many countries have legislation which limits the permissible amount of aflatoxin in cattle cake. Attempts have been made to detoxify the cattle cake, e.g. by the use of ammonia, but the cost and the undesirable side effects of such detoxification have so far prevented its use.

It is therefore desirable to sort the ground nuts so as to remove those affected by aflatoxin. There is, however, a major problem in connection with the sorting of such ground nuts by the use of light-sensitive detectors which are responsive to reflectance from the ground nuts. This problem is that ground nuts used as oil stocks are generally not treated with the care given to ground nuts used in confectionery, and the shelling of such oil stock ground nuts has normally resulted in a high percentage of skinned, partially skinned and split nuts whose kernel is visible to the light-sensitive detectors. It is therefore normally impossible for the detectors to determine whether an high level of reflectance from a ground nut in visible light arises merely from the presence of the said mould or from the visibility of the kernel due to the mechanical damage which has been done to the nut during the shelling. It is extremely important, however, that the sorting process should not involve the rejection of nuts merely because they have been mechanically damaged, since this might well involve the rejection of 60% of the nuts sorted, which would not be economical.

In our British Patent Specification No. 993,063 there is disclosed a sorting machine for effecting relative separation between ground nuts affected by a toxic mould and those not so affected. The sorting machine is arranged to direct ultra-violet and infra-red light onto ground nuts being viewed by two detectors which are respectively responsive to light of different wavelengths. The outputs of the two detectors are compared so as to produce a comparison signal which controls an ejector device for ejecting ground nuts affected by said toxic mould. One of the detectors is responsive to infra-red light and is provided to determine the extent to which the skin of the ground nut has been damaged or removed. The other detector is responsive to the colour in which the said toxic mould fluoresces due to said ultra-violet light and is thus provided to determine the extent to which the ground nut is affected by the said toxic mould.

We have now found, however, that the determination of the extent to which the ground nut is affected by the said toxic mould is best achieved by the use of a detector which is responsive to light whose wavelength is in the range 6,000 to 15,000 Å, and thus is responsive to red or infra-red light rather than to light of the colour in which the toxic mould fluoresces.

Moreover, in British Patent Specification, No. 993,063 the infra-red detector is used to determine the extent to which the ground nut is provided with a skin. We have now found, however, that all ground nuts which are not affected by a toxic mould are highly reflective in the red or infra-red irrespective of whether they have a skin, and consequently that it is most important that the detector which is provided to determine the extent to which the ground nut is provided with a skin is responsive to light in a part of the spectrum outside the red or infra-red.

SUMMARY OF THE INVENTION

According, therefore, to the present invention, there is provided a sorting machine for effecting relative separation between desired and undesired agricultural products, the machine comprising first and second detectors which are arranged to receive light from a said product being viewed, the said first detector being responsive to red and/or infra-red light whose wavelength is in the range 6,000 to 15,000 Å and the first detector being arranged to produce a first signal, the second detector being responsive to light of a wavelength outside the said range and being arranged to produce a second signal, comparator means for comparing the first and second signals and for producing a comparison signal therefrom, separator means for effecting the said relative separation, signal transmitting means comprising a gate and a level detector for transmitting the comparison signal from the comparator means to the separator means, and means unaffected by the value of the said first signal for supplying to said gate a gating signal which controls the operation of the gate in dependence upon the extent to which the product being viewed is mechanically damaged, whereby the separator means is actuated by comparison signals of a predetermined level only when the extent to which the product is mechanically damaged does not exceed a predetermined value.

Thus in the case of the present invention, the comparison signal is gated by a gating signal which is unaffected by the value of the signal from the red or infra-red detector, whereas the machine of British Patent Specification No. 993,063 does not employ a gating signal at all and its comparison signal is directly controlled by the infra-red detector.

Preferably, the machine is for effecting relative separation between mould-carrying agricultural products and agricultural products free of such mould.

Preferably, the first detector is responsive to infra-red light whose wavelength is in the range 7,300 to 8,000 Å.

Preferably there is a second level detector which is arranged to receive an input signal from the first detector and to pass an output signal to the separator means to actuate the latter when the value of the said input signal is indicative of a reflectivity of the product which is below a predetermined level. This enables both a "rough sort" to be done based merely on the extent to which the products reflect the red or infra-red light, and a "fine sort" based on the said comparison signals. The "rough sort" relies upon the fact that an high percentage of mould-carrying ground nuts or other agricultural products have low reflectance in the red or infra-red. Thus in this case the first detector has two functions, namely to form part of the means for producing the comparison signal, and also to form part of the means for effecting the said "rough sort".

The said second detector is preferably responsive to green light in the range 5,300 to 5,700 Å.

The means for producing the gating signal may include the said second detector, the said second signal being indicative of the extent to which the product is mechanically damaged. In this case the second detector has two functions, namely to form part of the means for producing the comparison signal and also to form part of the means for supplying the gating signal to the said gate.

Alternatively, the means for supplying the gating signal may comprise a third detector which is responsive to light whose wavelength is wholly or partly outside the range to which either the first or the second detector is responsive. The said third detector is preferably responsive to blue light in the range 4,500 to 5,200 Å.

Means are preferably provided, periodically operative when there is no product in the field of view, for protecting the or each level detector from drift.

The invention also comprises a method for effecting relative separation between desired and undesired agricultural products, said method comprising producing first signals in dependence upon the amount of red and/or infra-red light whose wavelength is in the range 6,000 to 15,000 Å and which is reflected by said products, producing second signals in dependence upon the amount of light of a wavelength outside the said range and which is reflected by the said products, comparing the first and second signals and producing comparison signals therefrom, transmitting the said comparison signals to a separator which effects the said relative separation, and employing a gating signal to gate the transmission of the comparison signals in dependence upon the extent to which the products being viewed are mechanically damaged, whereby the separator is actuated by comparison signals of a predetermined level only when the extent to which the products are mechanically damaged does not exceed a predetermined value.

Preferably, the method is used to effect separation between mould-carrying agricultural products and agricultural products free of such mould.

The products may be ground nuts, the said mechanical damage being constituted by damage to or removal of the skin of the ground nuts, or by splitting of the ground nuts.

DESCRIPTION OF THE PREFERRED EMBODIMENTS

Figure 1:
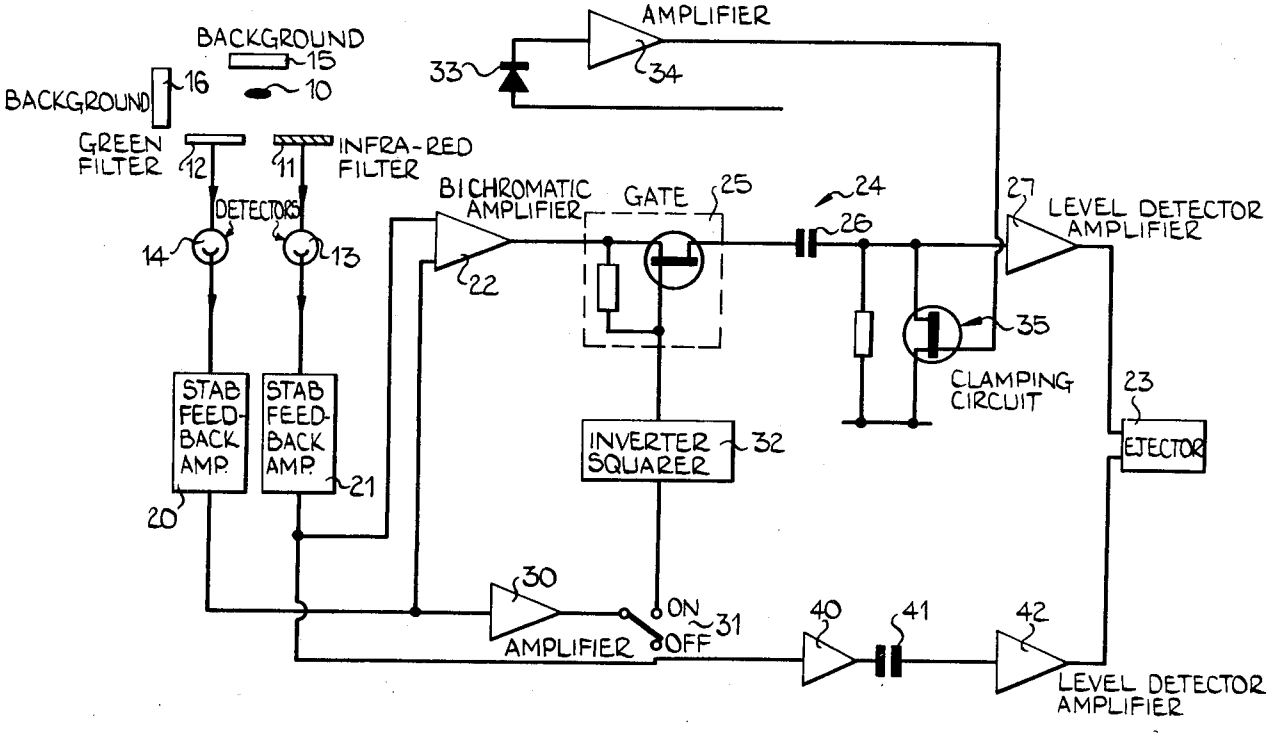
Figure 2:
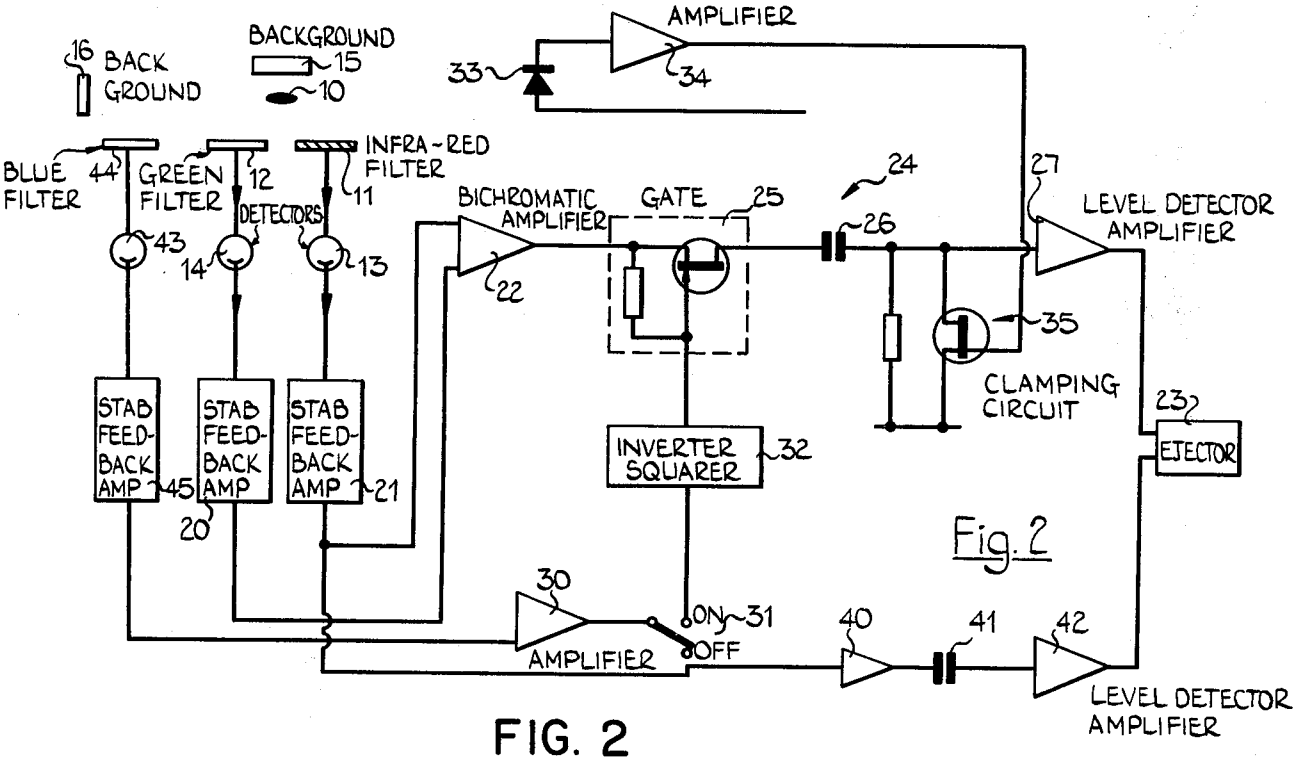

The invention is illustrated, merely by way of example, in the accompanying drawings, in which:

FIG. 1 is a circuit diagram of a first embodiment of a sorting machine according to the present invention, and, FIG. 2 is a circuit diagram of a second embodiment of a sorting machine according to the present invention.

In FIG. 1 there is shown a circuit diagram of a first embodiment of a sorting machine according to the present invention for sorting ground nuts affected by a mould which produces aflatoxin from those not so affected. Lamps (not shown) are provided to produce respectively a beam of visible light and an infra-red beam, and these beams are directed towards a point past which may fall, one at a time, a stream of ground nuts 10 from an endless belt (not shown).

Light from the ground nut 10 being viewed is directed through lens systems (not shown) and through filters 11, 12 onto photo-multiplier tubes or other light-sensitive detectors 13, 14 respectively. The detector 14 is a "green" detector, i.e. a detector responsive to green light in the range 5,300 to 5,700 Å, the filter 12 similarly being a "green" filter. The detector 13 is an "infra-red" detector, i.e. a detector responsive to infra-red light in the range 7,000 to 9,000 Å, and preferably in the range 7,300 to 8,000 Å, the filter 11 similarly being an "infra-red" filter. The detectors 13, 14 view the ground nut 10 against backgrounds 15, 16 whose colour is selected to produce the same average reflectance in the visible and infra-red light as the ground nuts 10 themselves, the background 15 serving to reduce the influence in the size of the ground nut 10 upon the amount of light received by the detectors 13, 14.

Although only one pair of detectors 13, 14 is shown, it is preferred to use a plurality, e.g. four such pairs and a corresponding number of backgrounds. For example, each pair of detectors may be respectively arranged at one side of an optical box (not shown) of the sorting machine.

The infra-red detector 13 is arranged to produce a first signal which is indicative of the amount of the said mould carried by the ground nut 10 being viewed, since the said mould has a very low reflectance in the infra-red. Thus the infra-red detector 13 is effecting a "dark" sort, i.e. is provided to detect ground nuts having low reflectance in the infra-red. The green detector 14 is arranged to produce a second signal which is indicative of the extent to which the ground nut 10 is mechanically damaged, i.e. the extent to which the kernel of the ground nut 10 is visible because of any partial or complete skinning of the ground nut 10 which may have occurred during shelling or any splitting of the ground nut 10 which may have occurred at this time. As will be appreciated, the magnitude of the second signal from the green detector 14 is affected by the amount of kernel visible, since the kernel is highly reflective in the green light. Thus the green detector 14 is provided to detect ground nuts having high reflectance in green light.

The signals from the detectors 14, 13 pass respectively by way of stabilised feedback amplifiers 20, 21 to a comparator which may be constituted by bichromatic difference amplifier 22 (or by a ratio amplifier) where the signals are compared with each other. The bichromatic difference amplifier 22 produces a resultant comparison signal which is transmitted to separator means such as an ejector 23 by way of signal-transmitting means 24 which comprise a gate 25, a condenser 26, and a level detector amplifier 27. If the comparison signal has not been gated by the gate 25, as described below, and has a magnitude greater than a predetermined level set by the level detector amplifier 27, the ejector 23 is operated by the comparison signal to remove the ground nut 10 which will in this case be a ground nut carrying the said mould since it will have a low degree of reflectance in the infra-red in relation to its reflectance in green light. The ejector 23 may, for example, direct a jet of compressed air onto the mould-carrying ground nut to remove it.

The said second signal from the green detector 14, in addition to being transmitted to the bichromatic difference amplifier 22, is also transmitted by way of an amplifier 30, a manually operable switch 31, and an inverter squarer 32 so as to provide an inverted square waveform gating signal to the gate 25. This gating signal, which is derived from the green detector 14 and which is thus unaffected by the value of the first signal from the infra-red detector 13, is thus supplied by the amplifier 30, switch 31 (when closed), and inverter squarer 32 to the gate 25 so as to control the operation of the latter in dependence upon the extent to which the ground nut 10 being viewed is mechanically damaged. As a result, the ejector 23 is actuated by comparison signals of a predetermined level, but is only so actuated when the extent to which the ground nut 10 is mechanically damaged does not exceed a predetermined value. Accordingly, ground nuts 10 will not be removed by the ejector 23 merely because they are highly reflective in the green light due to mechanical damage.

Light from the ground nut 10 being viewed, is directed (by means not shown) onto a photo diode detector 33 to produce a "clamping" signal which is transmitted by an amplifier 34 to a "clamping" circuit 35. The clamping circuit 35 short-circuits the signal-transmitting means 24 when there is no ground nut 10 in the field of view, whereby to protect the level detector amplifier 27 from drift, i.e. to prevent any drift in the value of the comparison signals which are actually transmitted to the ejector 23 to operate the latter. The clamping circuit may be arranged to effect such short-circuiting after each successive ground nut has just passed out of the field of view or may effect such short-circuiting after, say, each hundredth ground nut has just passed out of the field of view. If, however, the clamping circuit 35 were not provided, there would be a gradual drift in the level set by the level detector amplifier 27 so that the quality of the sorting mould deteriorate.

The first signal from the infra-red detector 13 is also transmitted by way of an amplifier 40, condenser 41, and level detector amplifier 42 to the ejector 23. The level detector amplifier 42, which thus receives an input signal from the infra-red detector 13, is arranged to pass an output signal to the ejector 23 to actuate the latter when the value of the said input signal is indicative of a reflectivity of the product in infra-red light which is below a predetermined level. By appropriate setting of the level of the level detector amplifier 42 it can be arranged that the ejector 23 will remove any ground nut 10 whose reflectance in the infra-red is low.

The clamping signal from the detector 33 is also transmitted to a second clamping circuit (not shown) which corresponds to the clamping circuit 35 and which prevents drifts of the level detector amplifier 42.

Accordingly the output signals from the level detector amplifier 42 cause the ejector 23 to perform a "rough" sort, while the output signals from the level detector amplifier 27 cause the ejector 23 to perform a "fine" sort.

In the construction shown in FIG. 1 each of the detectors 13, 14 performs two functions. That is to say, the green detector 14 forms part of the means for producing the said comparison signal and also forms part of the means for supplying the said gating signal to the gate 25. The infra-red detector 13 also forms part of the means for producing the said comparison signal, and at the same time forms part of the means which cause the ejector 23 to perform the "rough" sort. Thus the construction shown in FIG. 1 involves the use of very few detectors.

In contrast to the arrangement disclosed in our British Patent Specification No. 993,063, the machine shown in FIG. 1 does not sort in accordance with fluorescence from the ground nuts, and consequently avoids the problems which are associated with the low levels of light which are used to give rise to such fluorescence.

Although it is preferred that the detector 14 should be responsive to green light, it could if desired be responsive to other light, e.g. yellow light, whose wavelength is outside the range of the infra-red filter 11 and the infra-red detector 13. Moreover, although it is preferred that the detector 13 should be responsive to infra-red light, it could alternatively be responsive to any light whose wavelength is in the range 6,000 to 15,000 Å and thus could be responsive to red light.

In FIG. 2 there is shown a second embodiment of a sorting machine according to the present invention which is generally similar to that of FIG. 1 and which for this reason will not be described in detail, like reference numerals indicating like parts.

In the machine of FIG. 2, however, there is also employed a "blue" detector 43 which is responsive to blue light in the range 4,500 to 5,200 Å and which is thus responsive to light whose wavelength is outside the range to which either of the detectors 13, 14 is responsive. A "blue" filter 44 is provided for transmitting only blue light to the blue detector 43.

In the machine of FIG. 2 the second signal produced by the green detector 14 is transmitted to the bichromatic difference amplifier 22 but not to the amplifier 30. Consequently in the FIG. 2 construction the gating signal is not derived from the green detector 14. Instead, the gating signal is derived from the blue detector 43 and is transmitted to the amplifier 30, and hence to the gate 25, by way of a stabilised feedback amplifier 45.

Alternatively, the detector 43 could be responsive to any other light whose wavelength is wholly or partly outside the range to which either of the detectors 13, 14 is responsive. Thus the detector 43 could, for example, be responsive to yellow light in the range 5,750 to 6,050 Å.

We claim:

1. A sorting machine for effecting relative separation between desired and undesired agricultural products, the machine comprising first and second detectors which are arranged to receive light from at least one of said products being viewed, said first detector being responsive to light whose wavelength is in a range 6,000 to 15,000 Å and the first detector being arranged to produce a first signal, the second detector being responsive to light of a wavelength outside said range and being arranged to produce a second signal, comparator means for comparing the first and second signals and for producing a comparison signal therefrom, separator means for effecting said relative separation, signal transmitting means comprising a gate and a level detector for transmitting the comparison signal from the comparator means to the separator means, and means unaffected by the value of said first signal for supplying to said gate a gating signal which controls the operation of the gate in dependence upon the extent to which the product being viewed is mechanically damaged, whereby the separator means is actuated by comparison signals of a predetermined level only when the extent to which the product is mechanically damaged does not exceed a predetermined value.

2. A sorting machine as claimed in claim 1 in which machine is for effecting relative separation between the mould affected agricultural products and agricultural products unaffected by such mould.

3. A sorting machine as claimed in claim 1 in which the first detector is responsive to infra-red light whose wavelength is in a range 7,300 to 8,000 Å.

4. A sorting machine as claimed in claim 1 in which the means for supplying the gating signal includes said second detector, said second signal being indicative of the extent to which the product is mechanically damaged.

5. A sorting machine as claimed in claim 1 comprising means, periodically operative when there is no product in the field of view, for protecting the level detector from drift.

6. A sorting machine as claimed in claim 1 in which there is a second level detector which is arranged to receive an input signal from the first detector and to pass an output signal to the separator means to actuate the latter when the value of said input signal is indicative of a reflectivity of the product which is below a predetermined level.

7. A sorting machine as claimed in claim 6 in which said second detector is responsive to green light in a range 5,300 to 5,700 Å.

8. A sorting machine as claimed in claim 1 in which the means for supplying the gating signal comprises a third detector which is responsive to light whose wavelength is at least partly outside the range to which the first and the second detector is responsive.

9. A sorting machine as claimed in claim 8 in which the third detector is responsive to blue light in range 4,500 to 5,200 Å.

10. A method of effecting relative separation between desired and undesired agricultural products, said method comprising producing first signals in dependence upon the amount of light whose wavelength is in a range 6,000 to 15,000 Å and which is reflected by said products, producing second signals in dependence upon the amount of light of a wavelength outside said range and which is reflected by said products, comparing the first and second signals and producing comparison signals therefrom, transmitting said comparison signals to a separator which effects said relative separation, and employing a gating signal to gate the transmission of the comparison signals in dependence upon the extent to which the products being viewed are mechanically damaged, whereby the separator is actuated by comparison signals of a predetermined level only when the extent to which the products are mechanically damaged does not exceed a predetermined value.

11. A method as claimed in claim 10 in which the method is used to effect separation between mould-carrying agricultural products and agricultural products free of such mould.

12. A method as claimed in claim 10 in which the products are ground nuts, said mechanical damage being constituted by factors including damage to and removal of the skin of the ground nuts and splitting of the ground nuts.

* * * * *